US005888045A

United States Patent [19]

Schmeisser et al.

[11] Patent Number: 5,888,045

[45] Date of Patent: Mar. 30, 1999

[54] SCROLL STRIP STACK TRANSFER DEVICE

[75] Inventors: Heinz Schmeisser, Greenfield; James A. Franz, West Bend, both of Wis.

[73] Assignee: AMECO Corporation, Menomonee Falls, Wis.

[21] Appl. No.: 541,342

[22] Filed: Oct. 10, 1995

[51] Int. Cl.[6] ..... B65G 7/00

[52] U.S. Cl. ..... 414/626; 414/790.2; 414/766; 414/767; 414/789.1

[58] Field of Search ..... 414/790.2, 789.1, 414/790.5, 798.2, 789.9, 788.9, 765, 766, 767, 922, 626, 800, 801, 802

[56] References Cited

U.S. PATENT DOCUMENTS

| | | | |
|---|---|---|---|
| 3,710,955 | 1/1973 | Redman et al. | 414/765 |
| 3,868,101 | 2/1975 | Nozaki et al. | 414/766 X |
| 4,013,177 | 3/1977 | Kinnicutt, Jr. et al. | 414/767 |
| 5,122,030 | 6/1992 | Schmeisser et al. . | |
| 5,333,985 | 8/1994 | Schmeisser et al. . | |

FOREIGN PATENT DOCUMENTS

| | | | |
|---|---|---|---|
| 233657 | 8/1987 | European Pat. Off. | 414/766 |
| 3712939 | 11/1988 | Germany | 414/790.2 |
| 190116 | 10/1984 | Japan | 414/789.1 |
| 12540 | 1/1987 | Japan | 414/790.2 |

*Primary Examiner*—Frank E. Werner
*Attorney, Agent, or Firm*—Hill & Simpson

[57] ABSTRACT

An apparatus for collecting strips of metal into stacks and transfering the stacks to a hopper of a press includes a stack accumulating and blocking pocket at an output of a cut-off shear, a stack lift, rotate and turn-over mechanism to reorient the stack prior to input to the hopper, and a gripper head on a transfer gantry to move the stack from the lift, rotate and turn-over mechanism to the hopper. The gripper head is movable to an angle in alignment with the feed angle of the hopper to deposit the stack on the top strip in the hopper in alignment therewith.

6 Claims, 19 Drawing Sheets

SCROLL STRIP STACK TRANSFER DEVICE

BACKGROUND OF THE INVENTION

1. Field of the Invention

The present invention relates generally to an apparatus for re-orienting and transporting strips of material, and, in particular, to an apparatus for turning and transporting strips of metal, such as strips from which can ends are formed, to a hopper.

2. Description of the Related Art

Metal cans are commonly used to store food and drink products. The metal cans are usually formed of steel or aluminum and are most commonly of a cylindrical shape, although cans having a generally rectangular shape, often with rounded corners, are also used. The cans often have embossed shapes on the sides and the ends to strengthen the can. The metal of which cans are formed is often coated with coating material, especially on the inside surface of the can. The coating material is dependent on the food to be stored in the can. For example, tomato products require a coating that resists the acid from the tomatoes.

Three piece metal cans are formed from a usually cylindrical body and two end pieces that are attached at the respective ends of the cylinder. The first end cap is attached to the can body prior to filling the can and the second end cap is attached after the can is filled. Two piece cans are also used in which the bottom of the can is formed integrally with the sidewalls. The end cap is placed on the can body after the can is filled. The end pieces, either two end pieces for a three piece can or one for a two piece can, are disks of metal which are formed by, first, cutting coils of the steel or aluminum into strips, referred to as scroll strips, using a scroll shear. The scroll shear may also form any embossed shapes, or scrolls, on the can ends, as needed. Then the scroll strips are transported to an input hopper of a scroll press where the can ends are cut from the scroll strips. The can ends are thereafter transported either to an apparatus for affixing the first can end to the cylindrical can body of a three piece can, or to the canning plant for placement on the filled can.

To reduce waste to a minimum during cutting of the can ends, the scroll strips are shaped with irregular edges. The edge shapes are often not symmetrical and so the scroll strips can be fed at only one orientation into the hopper of the scroll press. Further, the scroll shapes or embossings on the strips may require a particular orientation of the scroll strips in the hopper. Additionally, the coatings which are on the ends require that a particular orientation top for bottom of the strips in the hopper of the scroll press. Therefore, it is often necessary to turn the scroll strips end-for-end and/or to rotate the scroll strips top-for-bottom prior to feeding the strips into the hopper.

The scroll strips from which the can ends are to be cut are output from the scroll shear at high speed and are currently transported by hand from the output of the scroll shear to the hopper on the scroll press. The scroll press also operates at high speed. Thus, the hand loading of the hopper must be performed quickly, usually by placing a stack of the strips into the hopper several times a minute. The scroll strips are long, for example, 36 inches in length, and are flexible so that they bow in the middle when handled. Add this to the fact that since they are of steel and are heavy and that they must be rotated end-for-end and/or top-for-bottom during the handling step leads to a difficult and monotonous task.

A popular model of shear press has its input hopper positioned at an angle behind a portion of the machinery, so that feeding the scroll strips into the hopper requires reaching over the machinery and placement of the strips in the angled hopper. Workers for such a task are prone to injury in addition to exhaustion and boredom.

Packaging of products, such as food products, is market driven by size. Instead of changing a price of the product, the size is changed, sometimes by only small amounts. Therefore, great demands are placed on a can manufacturing facility to change the sizes of the cans rapidly with as little down time as possible.

SUMMARY OF THE INVENTION

The present invention provides an automatic scroll strip transporting apparatus and method for moving the scroll strips from the output of a scroll shear to an input hopper of a scroll press, including rotation end-for-end and turning top-for-bottom of the strips as needed.

In particular, the present apparatus includes a means for catching the output scroll strips from the scroll shear and accumulating the strips to a predetermined height. When the predetermined height is reached, the present apparatus squares, or blocks, the stack and transports the stack to a lift, rotate and turn-over mechanism where the stack is rotated if needed, turned over if needed, and lifted for engagement by grippers. A gripping head grips the lifted stack and transports it to a position over the scroll press hopper. The gripping head is then turned at an angle matching the hopper feed path and the stack is lowered onto the top of the strips in the hopper and released.

The present invention further provides for quick change-over from one size scroll strip to another size scroll strip in a can manufacturing facility. Each of the strip engaging portions of the present apparatus is readily removable and/or changeable to a position to accommodate different sizes and configurations of scroll strips. In addition, the transfer apparatus and the lift, rotate and turn over apparatus of the present invention is mounted on a single base that is supported on rollers. A motorized drive moves the unit on the rollers so that it is easily moved out of the way when servicing or changing over the scroll shear to which it is adjacent.

An additional feature of the present invention is that the scroll strips received by the present apparatus from the scroll shear are automatically placed in a storage location when they are not needed by the scroll press. For example, when the scroll press hopper is full, the output of the scroll shear may be stacked on storage pallets for later use. This is particularly useful since the scroll shear can operate at, for example, twice the speed of the scroll press. Thus, inventory is created for use by another scroll press or for use during times when the scroll shear is not operating.

DETAILED DESCRIPTION OF THE PREFERRED EMBODIMENTS

Figure 1:
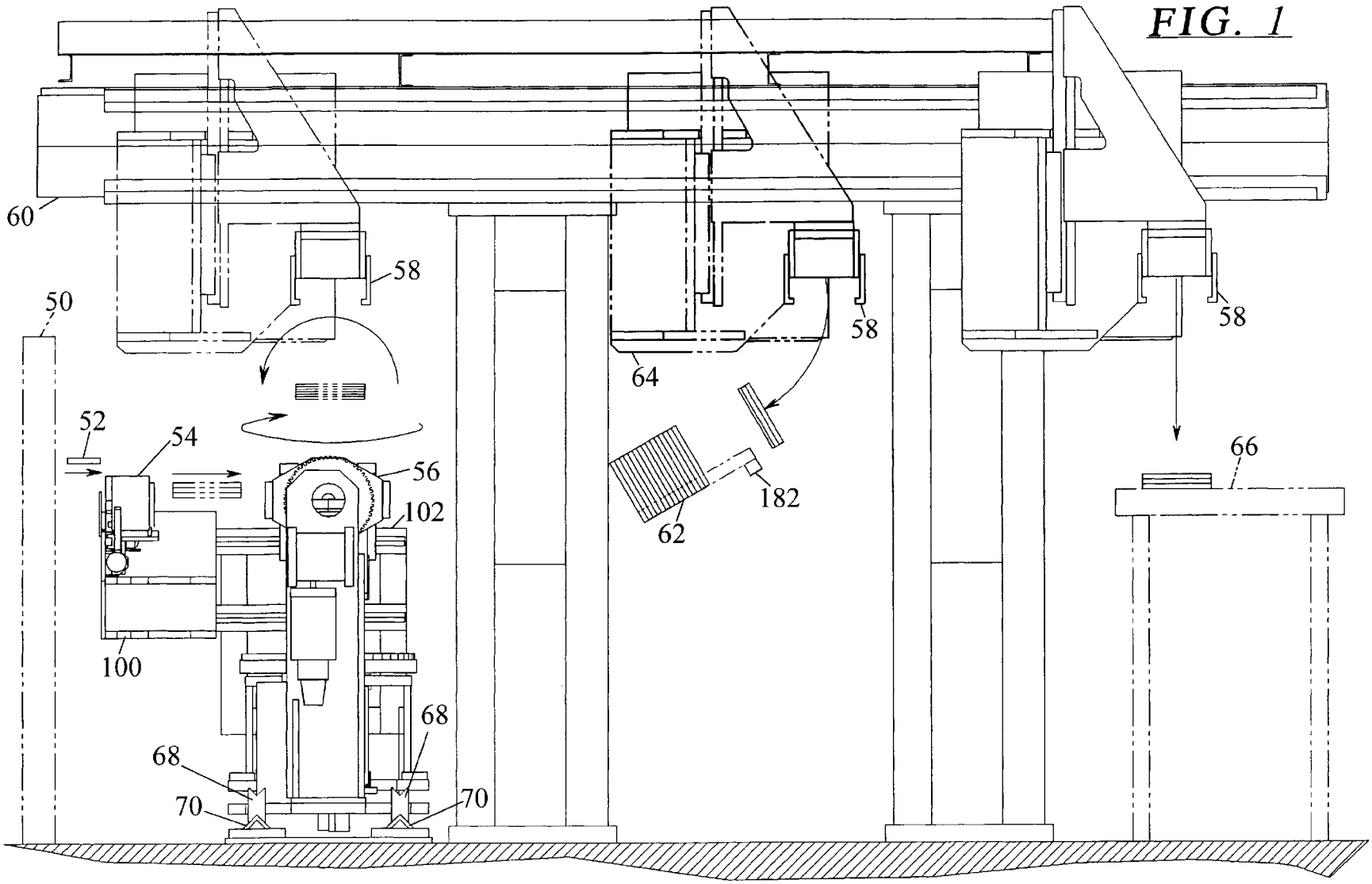
FIG. 1 is a side elevational view of the scroll strip transfer device of the present invention.

Referring first to FIG. 1, a scroll shear, or cut-off shear, 50 is shown schematically. The scroll shear 50 outputs scroll strips 52 to an accumulating and blocking pocket 54 which transfers a stack of the strips 52 to a lift, rotate and turn-over mechanism 56. After reorientation of the stack of strips in the lift, rotate and turn-over mechanism 56, the stack is gripped by a gripper head 58 that is supported on a gantry 60. The gantry 60 moves the gripper head 58 from a position over the lift, rotate and turn-over mechanism 56 to a position over a hopper 62, which is shown schematically, and then a head rotation mechanism 64 is operated to turn the head to the angle of the hopper 62 and lower the stack thereinto. If the hopper 62 is full, the gantry 60 moves the gripper head 58 to a position over a storage location 66 where the gripper head deposits the stack for later use.

As is known, such cut-off shears 50 have a coil of steel or aluminum at an input from which is cut scroll strips 52. The scroll strips 52 are output side-by-side one at a time as they are cut from the steel material. Although the length of the strips 52 depends on the width of the coil feeding the scroll shear 50, one embodiment outputs strips that are 36 inches in length. The width and edge shape of the strips depends upon the arrangement of end pieces to be cut from the strip.

It is, of course, also possible that the scroll shear cuts the scroll strips from flat sheets instead of from a coil. The material from which the strips are cut may be aluminum or other metals or non-metal materials, including laminates, and may include coatings, paint or the like. The present apparatus is constructed to avoid or reduce the likelihood that these coatings are scratched or damaged during handling of the strips so that optimum throughput is achieved.

Changes in the sizes and shapes of the can ends being formed must be made during the regular operation of the can forming process. To facilitate the change over and provide access to the scroll shear 50, the lift, rotate and turn-over mechanism 56 with the accumulation and blocking pocket 54 is mounted on wheels 68 that ride on rails 70.

Figure 2:
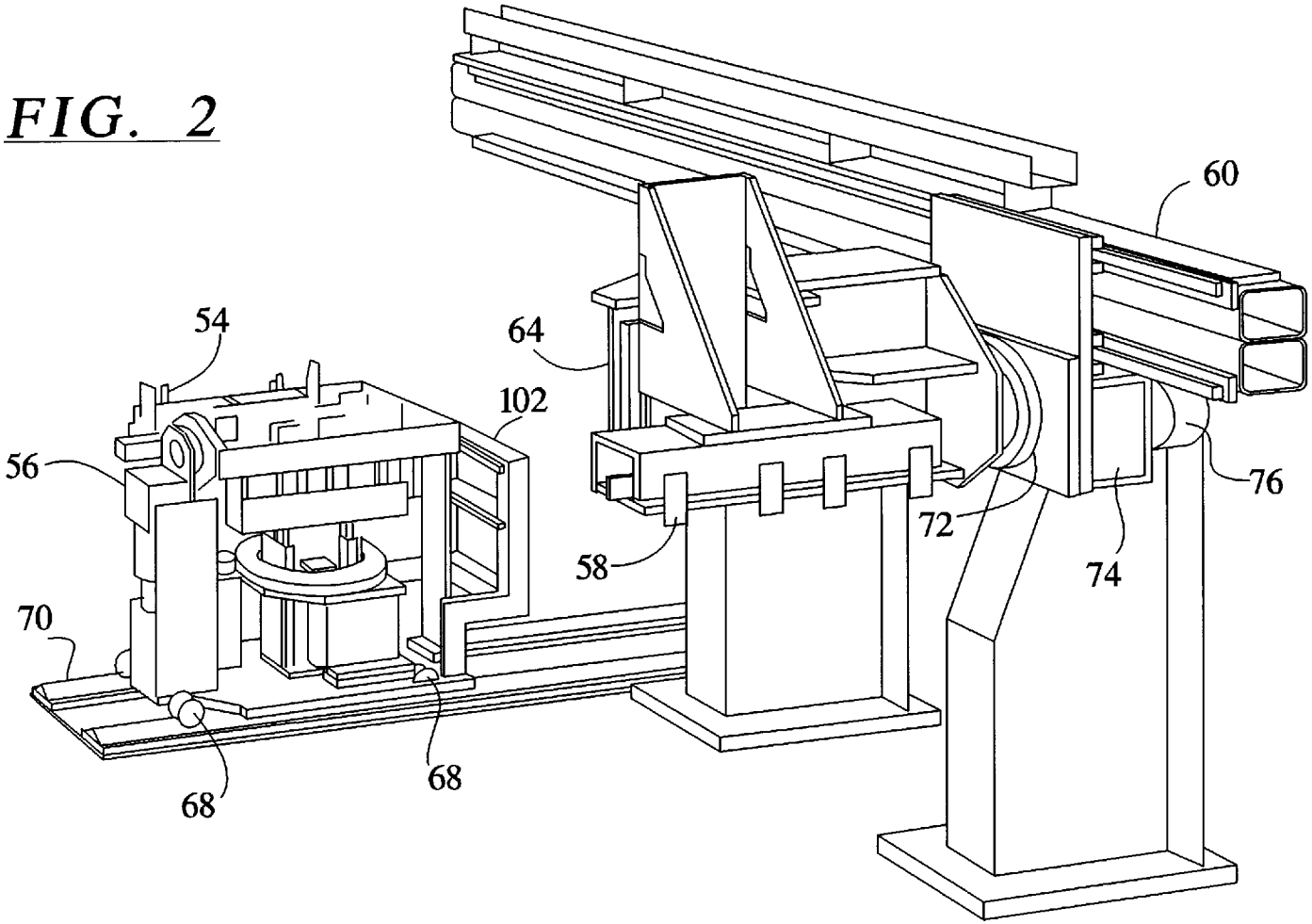
FIG. 2 is a perspective view of the scroll strip transfer device.

The relative arrangement of the parts is better seen in FIG. 2, including the gripping head 58 and head rotation mechanism 64 extending from the side of the gantry 60. A head rotate bearing 72 driven by a gear box 74 and motor 76 is seen in the FIG. 2 to enable the rotational motion of the gripper head 58.

Figure 3:
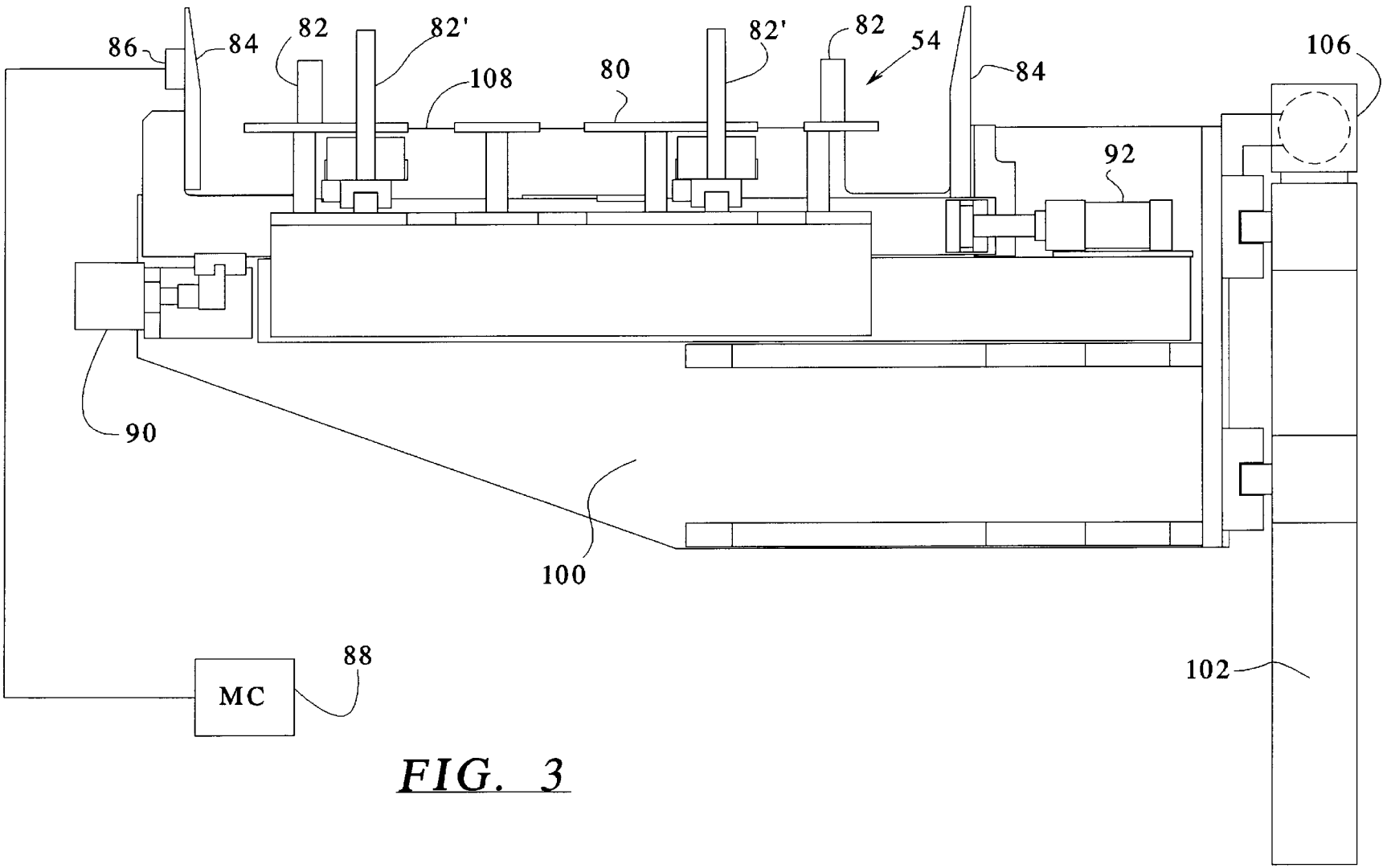
FIG. 3 is a side elevational view of a stack accumulating and blocking mechanism of the scroll strip transfer device.
Figure 4:
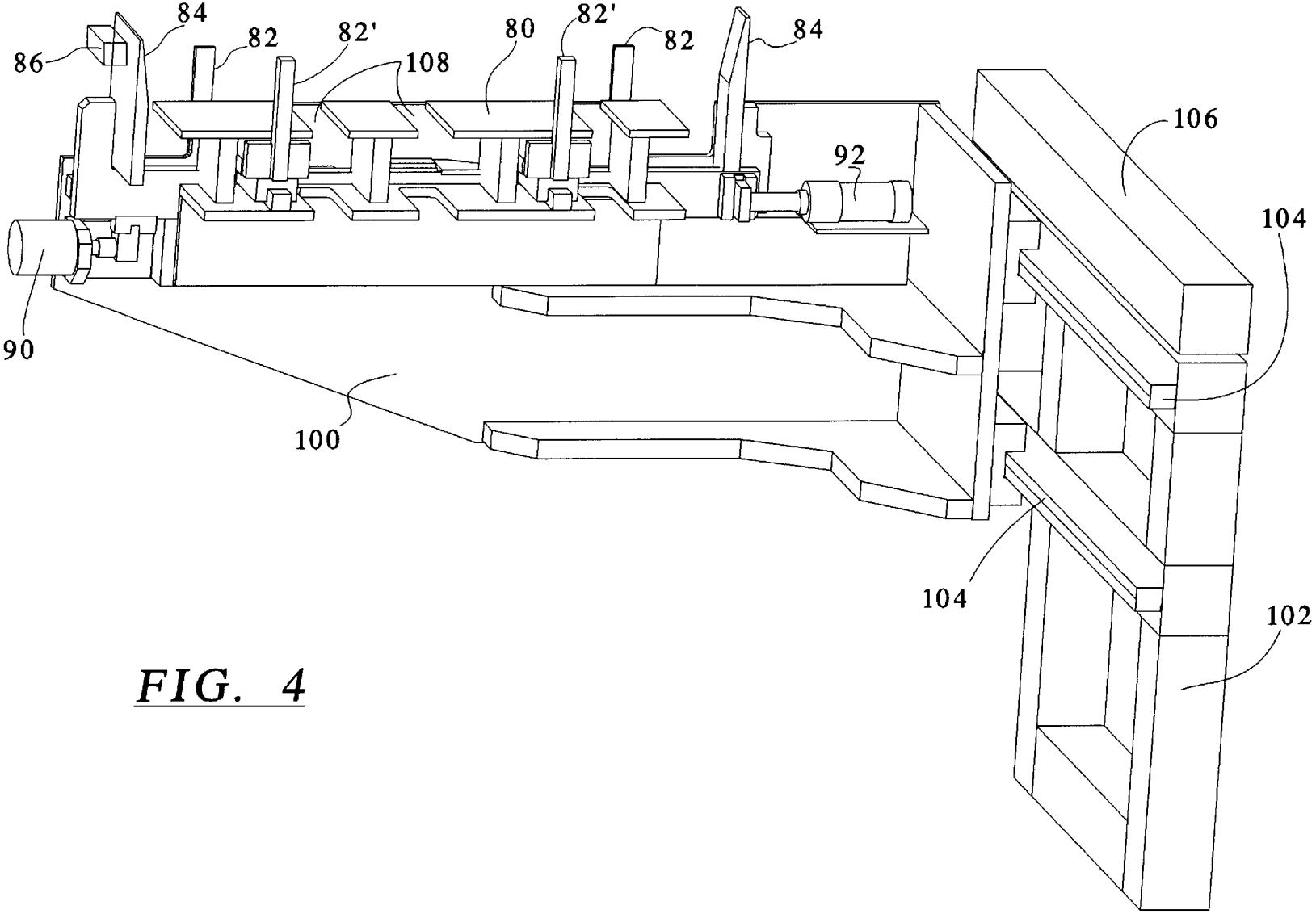
FIG. 4 is a perspective view of the stack accumulating and blocking mechanism of FIG. 3.
Figure 5:
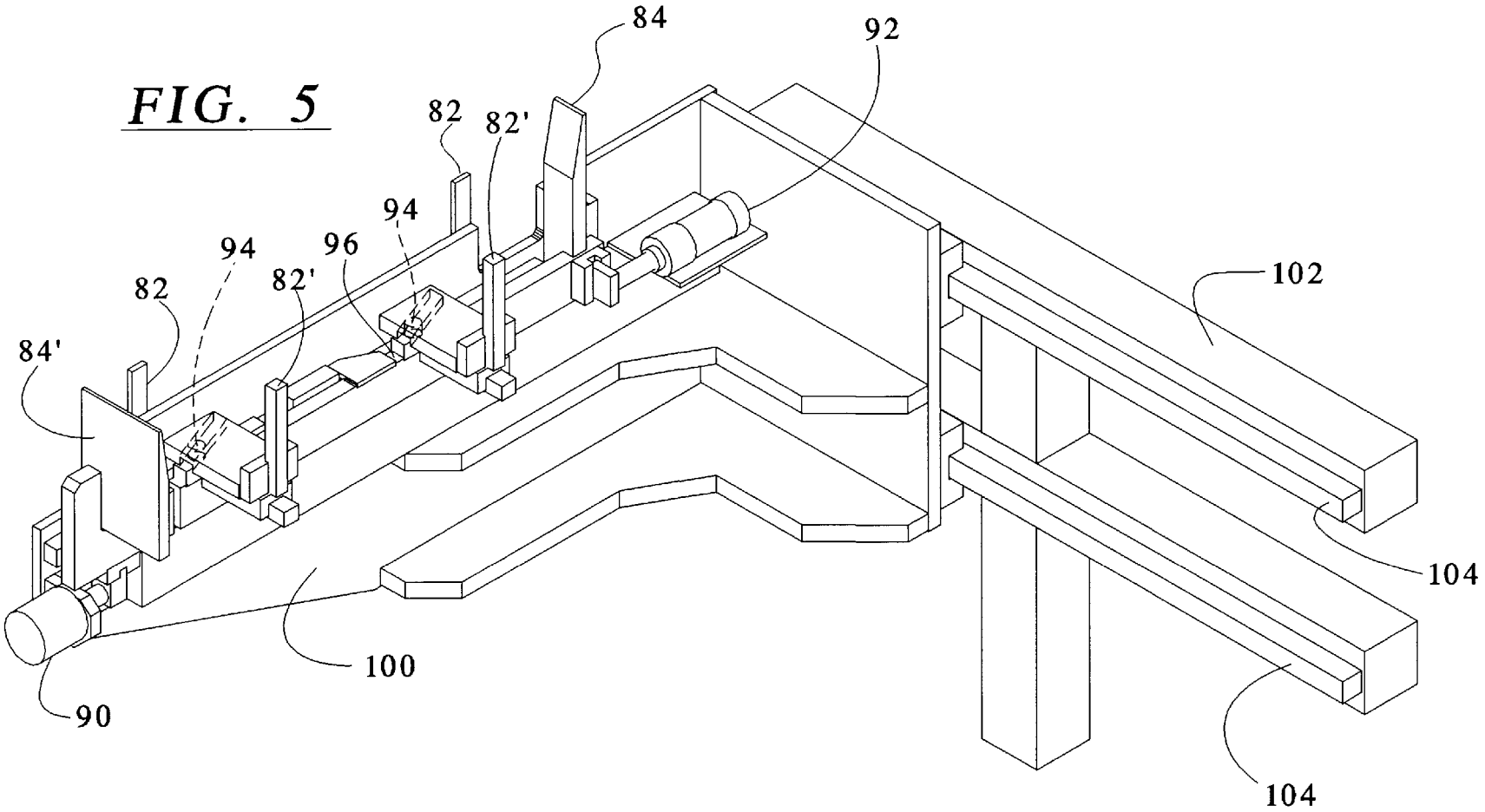
FIG. 5 is a perspective view of the stack accumulating and blocking mechanism of FIG. 4 with a support platform removed to shown the blocking operation.

Referring to FIGS. 3 and 4, the scroll strips 52 are fed by the scroll shear 50 into a receiving pocket 54 of the present apparatus. The receiving pocket has a bottom support 80 on which the strips rest and side 82 and end uprights 84 between which the strips fall and are held as they are fed from the scroll shear. The receiving pocket 64 also has a sensor 86 to determine when a predetermined height of the strips is accumulated in the receiving pocket 54. When the sensor 86 detects the predetermined height, for example, 1.5 inches, of strips in the receiving pocket, the sensor signal is sent to a master control 88 that causes a vacuum feed on the input of the scroll shear 50 to shut off and a blocking action is undertaken by the receiving pocket 54. The blocking, or squaring, action is performed by the uprights 82 at one side of the receiving pocket moving inwardly and the upright 84 at one end of the receiving moving inwardly, each toward the opposed upright to align the strips with one another.

First and second blocking motors 90 and 92 and cam arrangements 94 for the movable uprights 82 and 84 move the uprights in the blocking motion. The cam arrangements 94 are operated by the motor 92 through a longitudinal member 96 to move the side uprights 82'. The motor 90 moves the end upright 84'. The blocking motors 90 and 92 are operated by the master controller 88. The inward movements of the uprights are followed by the uprights 82' and 84' moving back to their original positions so that the strips are not held by the uprights.

A stack of the strips has now been accumulated and blocked and is ready for transfer to lift, rotate and turn-over mechanism 56. To accomplish the transfer, the receiving pocket 54 is supported on an arm 100 extending from a frame 102. The arm 100 rides on two rails 104 on the frame 102 so that the arm 100 is movable horizontally between a first position with the receiving pocket 54 at the output of the scroll shear 50 and a second position at the lift, rotate and turn-over mechanism 56. Movement of the arm is accomplished by a rodless pneumatic cylinder 106, such as made by Origa, that is mounted at the top of the frame 102. The arm 100 is attached to the actuator of the cylinder 106 as shown in FIG. 3, which is under the control of the master controller 88.

Figure 6:
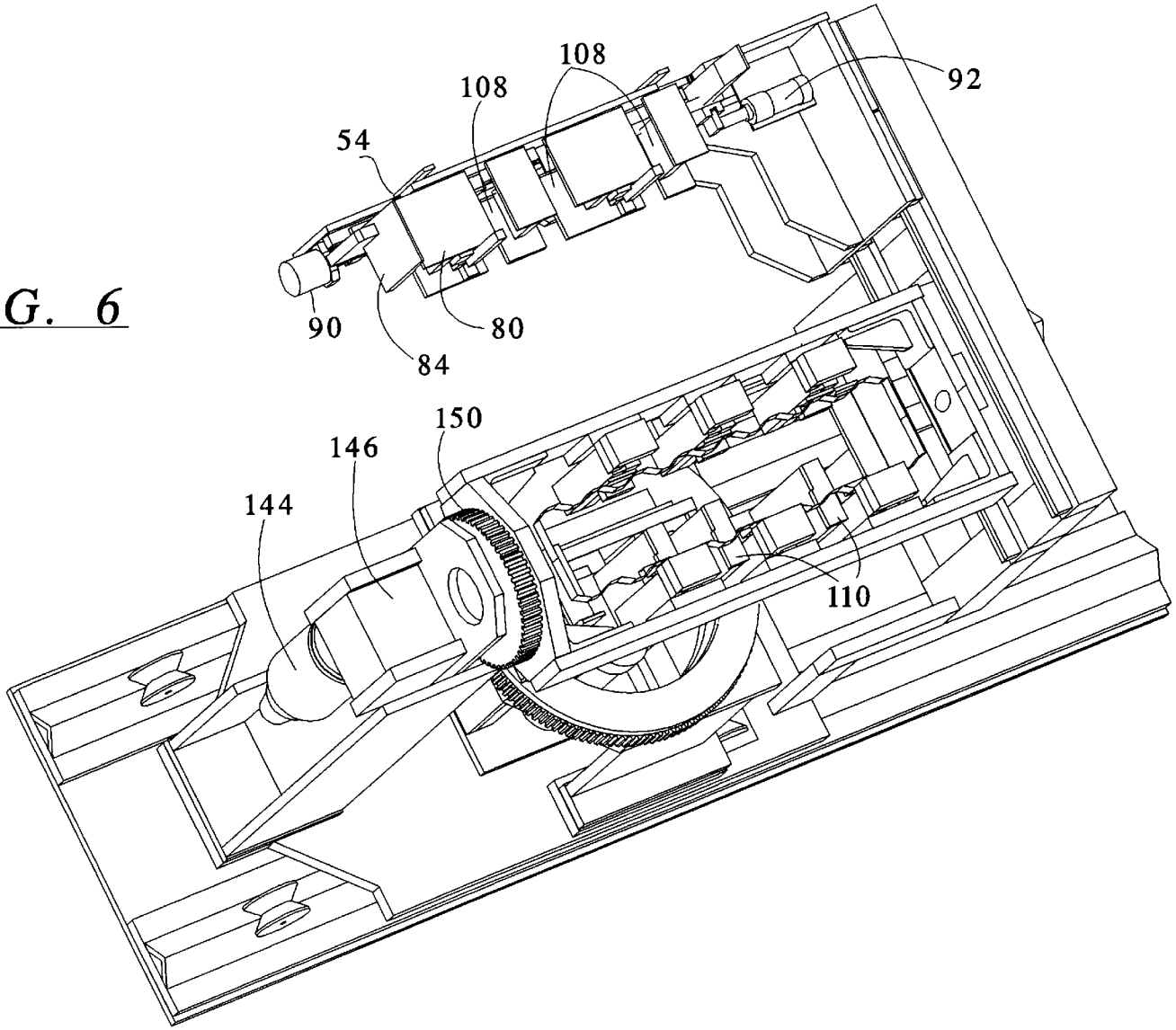
FIG. 6 is a top perspective view of the stack accumulating and blocking mechanism with a lift, rotate and turn-over apparatus of the present invention.
Figure 10:
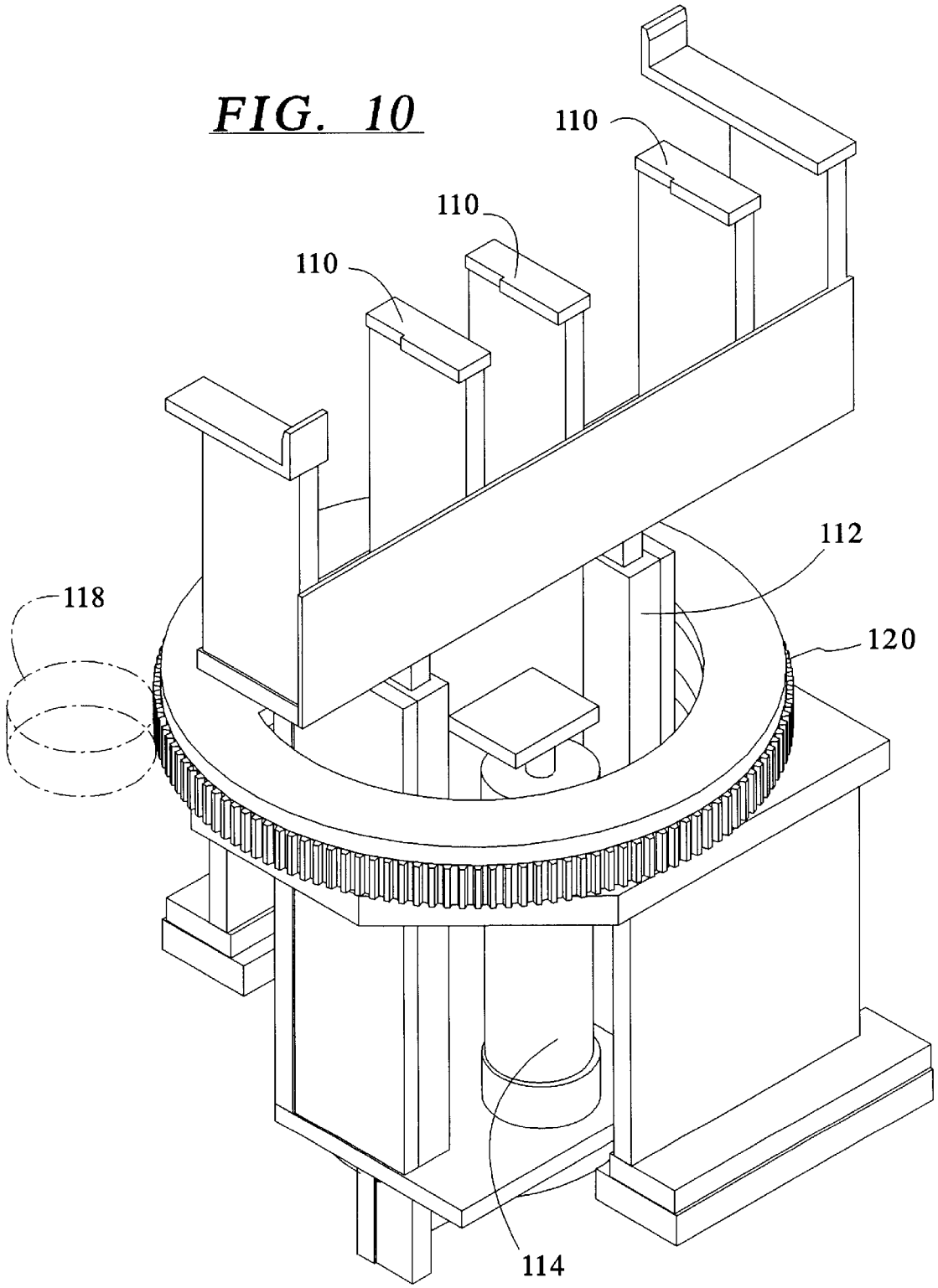
FIG. 10 is a top perspective of the lift and rotate portions of the lift, rotate and turn-over mechanism.
Figure 11:
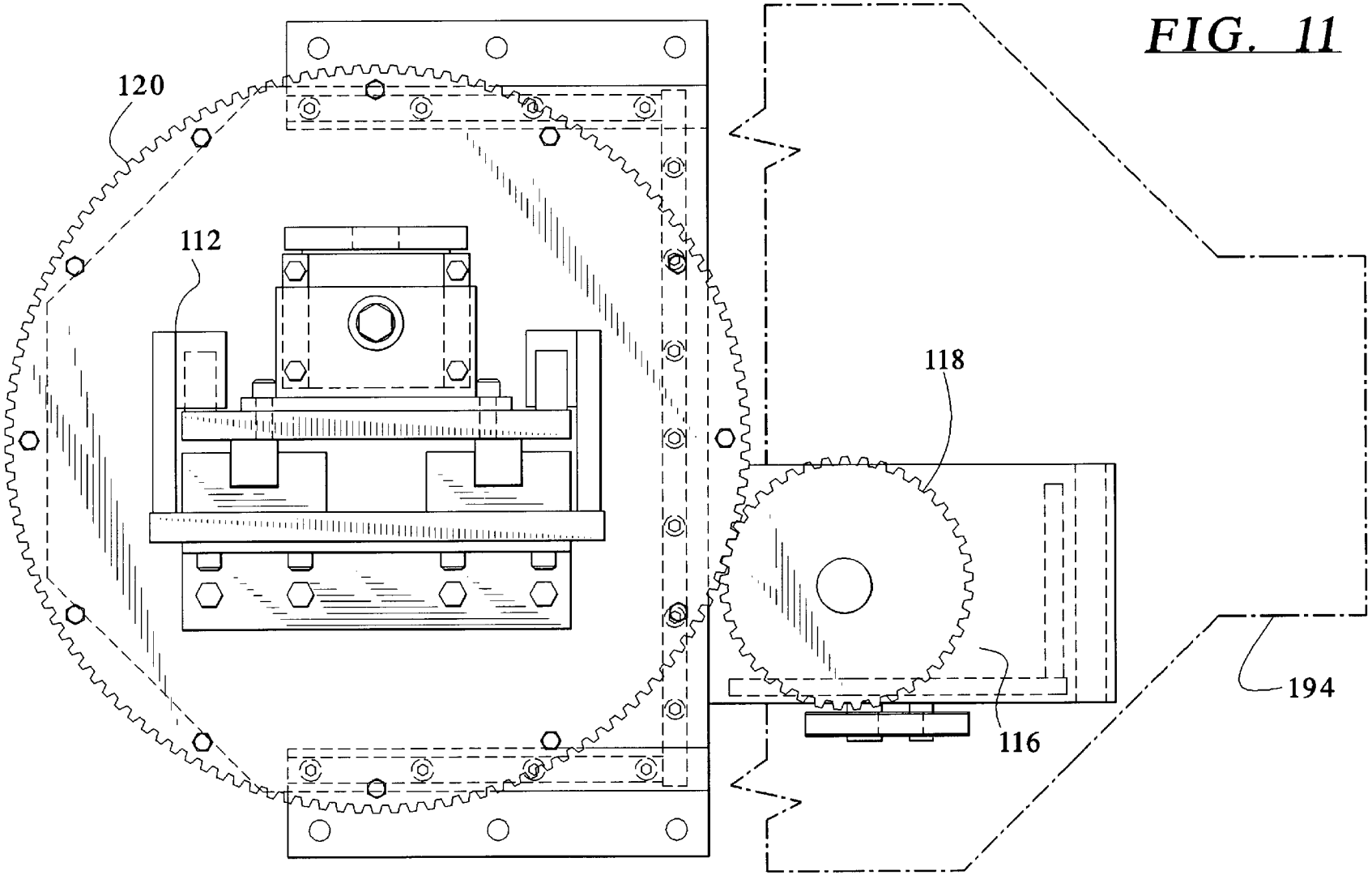
FIG. 11 is a plan view of the rotate portion of the lift, rotate and turn-over mechanism.

The support surface 80 of the receiving pocket 54 has slots 108 therein, as seen in FIG. 6. The strip supporting portion 110 of a lift mechanism 112, in FIG. 10, of the lift, rotate and turn-over mechanism 56 has a plurality of support surfaces which are spaced from one another along the length of the strip and are positioned to fit in the slots 108 of the support surface of the receiving pocket 54 when the receiving pocket is in the second position. During the stack transfer step as the receiving pocket 54 is moved to the second position, the lift mechanism 112 of the lift, rotate and turn-over mechanism is in its lower position. Once the receiving pocket 54 has reached the second position, the lift mechanism 112, which is under the control of the master controller 88, raises the strip supporting portion 110 so that it passes through the slots 108 in the receiving pocket 54 and engages the stack of strips therein. Lifting is continued until the stack clears the uprights 82 in the receiving pocket, and then the receiving pocket 54 is moved back to its first position by the cylinder 106.

After the receiving pocket 54 reaches the first position, the vacuum feed for the scroll shear 50 is turned on and scroll strips are once again fed into the receiving pocket 54. This cycle continues so long as stacks of strips are required in a hopper of a scroll press. If the hopper becomes full, as determined by sensors connected to the master controller, the feed to the scroll shear is interrupted until more strips are needed. An alternate arrangement provides for continued operation of the scroll shear, however, and transfer of the stacks of strips to a storage location 66, as will be described later.

The stack of strips has now been transferred to the lift mechanism 112 and is resting on the supporting surface 110 thereof. The lift mechanism 112 is operated by a pneumatic lift cylinder 114 which is under the control of the master controller 88. Both the lift mechanism 112 and the lift cylinder 114 are mounted for rotation about a vertical axis. A rotation drive motor 116 is provided with an output gear 118 that is connected to a bull gear 120. The bull gear 120 encircles the lift mechanism 112 and thereby forms a rotation mechanism of the lift, rotate and turn-over mechanism 56. As with other operating components, the rotation drive motor 116 is controlled by the master controller 88.

The edge shape of the scroll strips is irregularly formed in a predetermined shape to maximize the number of can ends that can be cut from a given quantity of sheet metal and to reduce waste. The irregular shaped edge is generally not symmetrical about the longitudinal axis of the strip. Therefore, the strips must be fed into the scroll press hopper with a predetermined orientation which may require that the strips be turned end-for-end before transfer to the hopper. The rotation mechanism 120 performs this end-for-end rotation when needed. When the scroll shear and the scroll press is changed to another can end shape or size, rotation of the strip may not be needed. However, when another size or shape of can end is made, the strips may require rotation. Thus, the user of the present apparatus sets the master controller 88, which is a numeric or computer control, to rotate the strips when needed, and to leave the strips in their original orientation when no rotation is needed.

Figure 9:
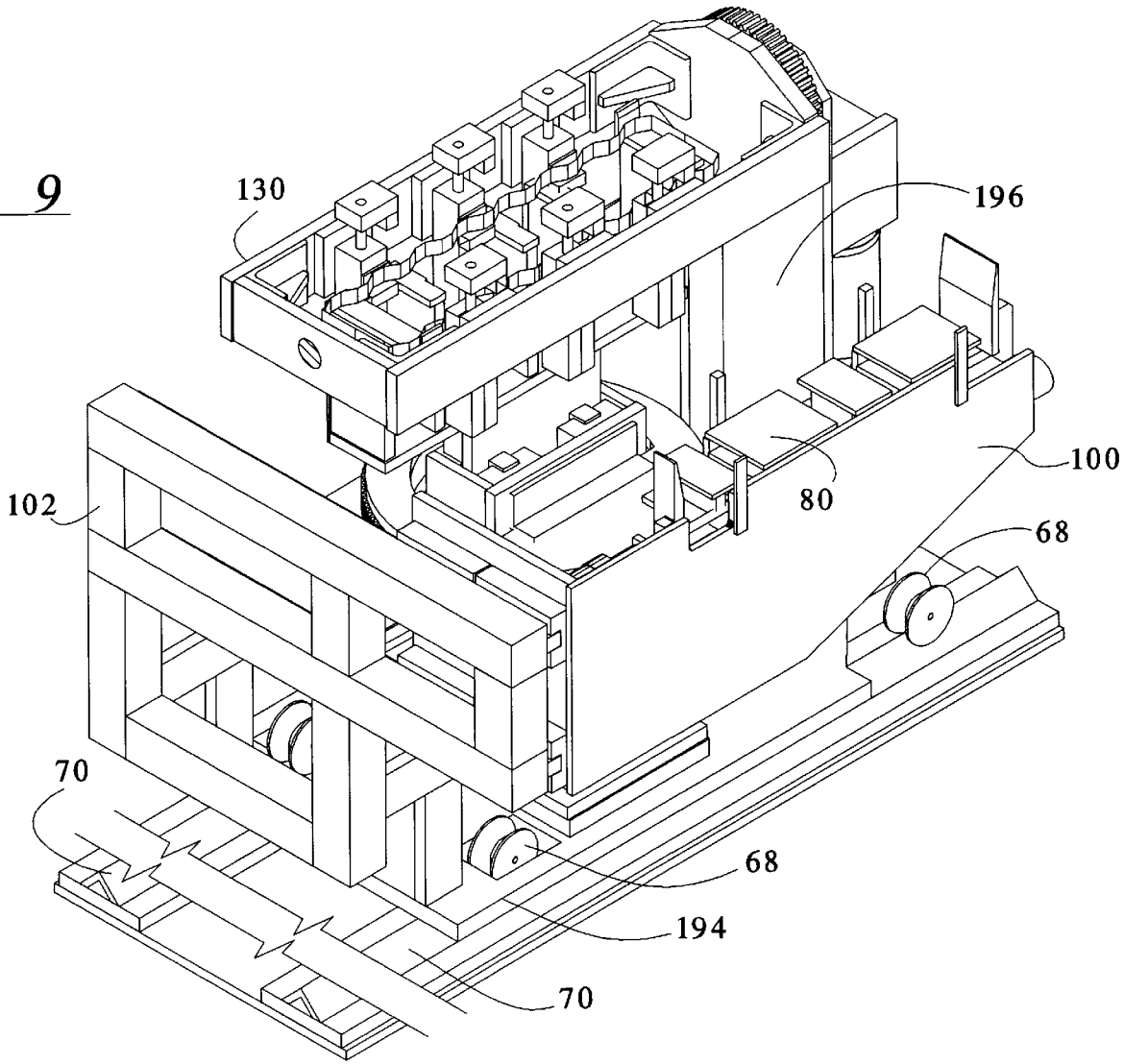
FIG. 9 is a rear perspective view of the lift, rotate and turn-over mechanism of FIG. 6.

The scroll strips may have a coating or scroll embossing pattern or painted design which requires that one side of the strips be facing up when fed into the scroll press hopper 62. Therefore, the lift, rotate and turn-over mechanism 56 also is selectively capable of performing a top-for-bottom turn over of the stack of strips. A turn-over mechanism 130 is therefore provided which includes a frame 132, in FIGS. 6, 7, and 9, positioned over the lift mechanism 112. The frame 132 includes stop blocks 143, in FIG. 12, positioned to bear against the edges of the stack 136 when the stack is lifted vertically by the lift mechanism 112. The turn-over mechanism 130 also includes clamps 138 that pivot between two positions, wherein a first position is out of the path of the stack 136 as it is lifted into the frame by the lift mechanism 112 and a second position in which the clamps 138 are moved against the stack opposite the stop blocks 134. The clamps 138 include goose-neck shaped members 140 that are moved between the two positions by pneumatic cylinders 142 under the control of the master controller 88.

Figure 12:
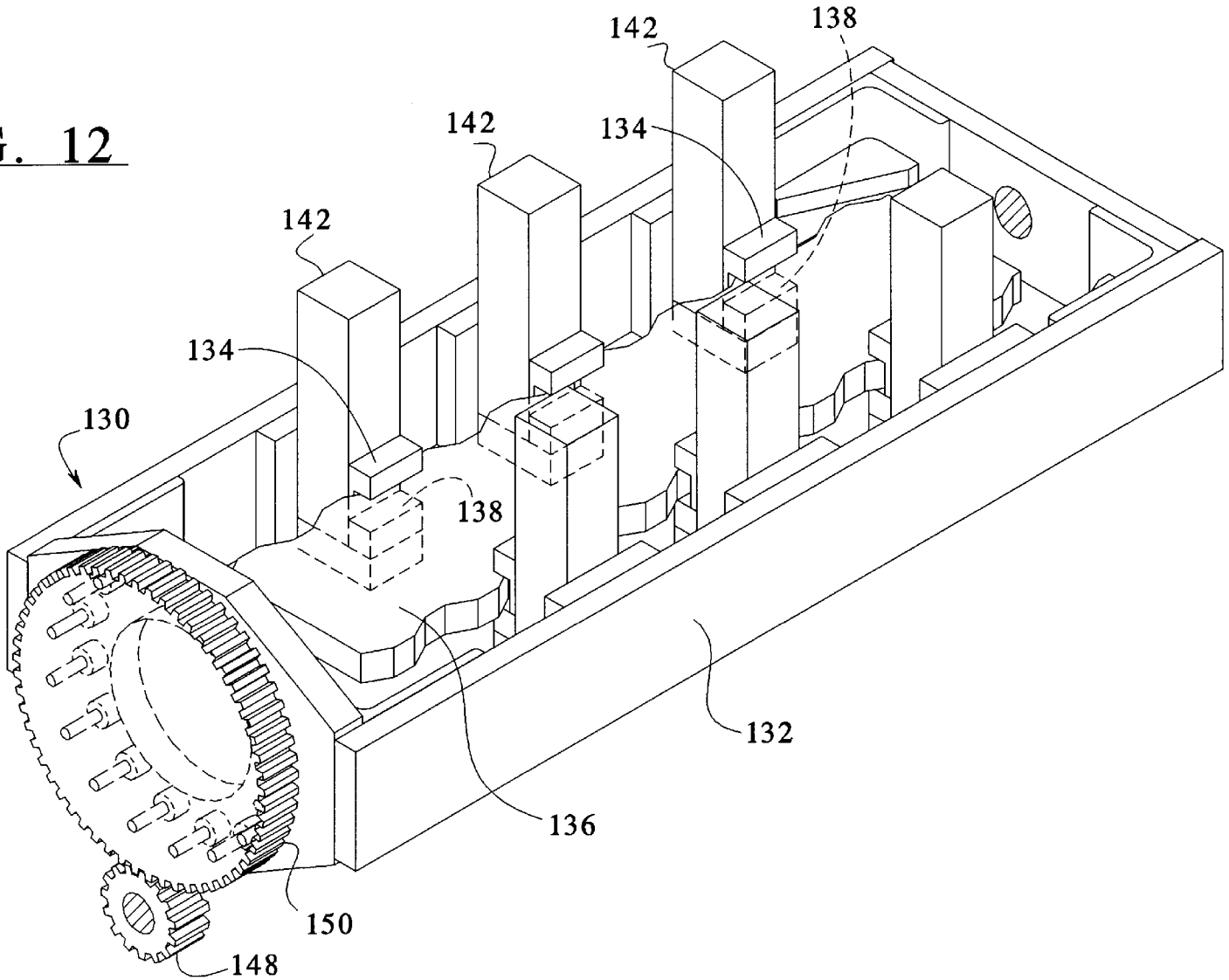
FIG. 12 is a top perspective view of a turn-over portion of the lift, rotate and turn-over mechanism.

In operation, the stack 136 is lifted vertically to a position within the frame 132 of the turn-over mechanism 130 until the stack is near to or pressing against the stop blocks 134. The clamping apparatus 140 rotates from a position out of the path of the stack to a position below the stack and is moved upward to pull the stack against the stop blocks, as shown in FIG. 12. The stack is thereby held in the frame of the turn-over mechanism 130. The lift mechanism 112 is lowered so that it is free of the turn-over mechanism 130. The frame of the turn-over mechanism is then rotated top-for-bottom about a horizontal axis by activation of a turn-over motor 144, in FIG. 6, that drives the frame 130 through transmission 146, a drive gear 148 and a driven gear 150 arrangement. The driven gear 50 is affixed to the end of the frame 132 as shown in FIG. 12.

Figure 13:
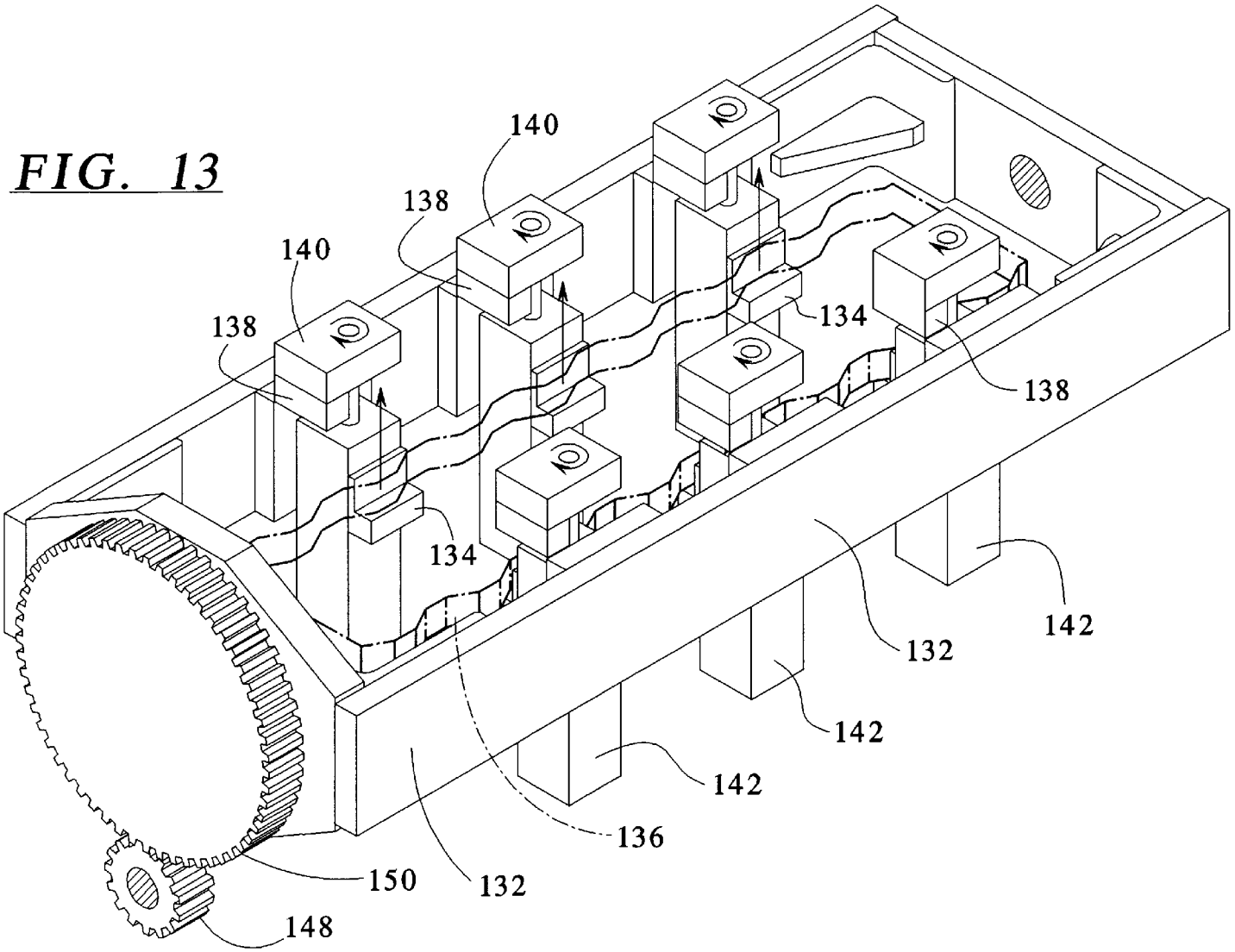
FIG. 13 is a perspective view of the turn-over portion of FIG. 12 shown after the turn-over frame has been turned top-for-bottom, including arrows illustrating the movement of clamping apparatus.
Figure 14:
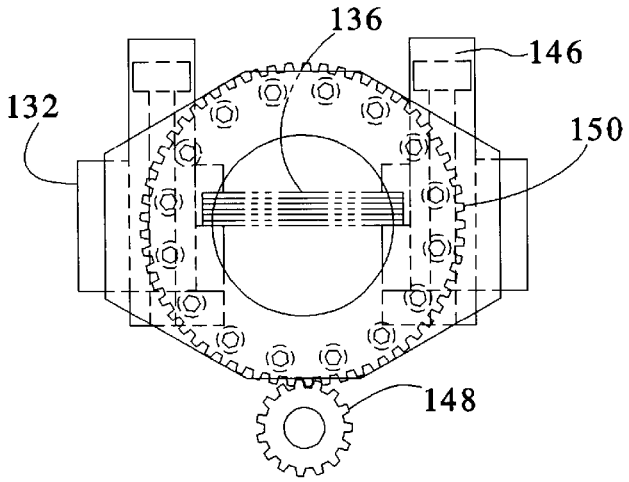
FIG. 14 is an end view of the turn-over portion of FIG. 12 showing a stack of strips held therein.
Figure 16:
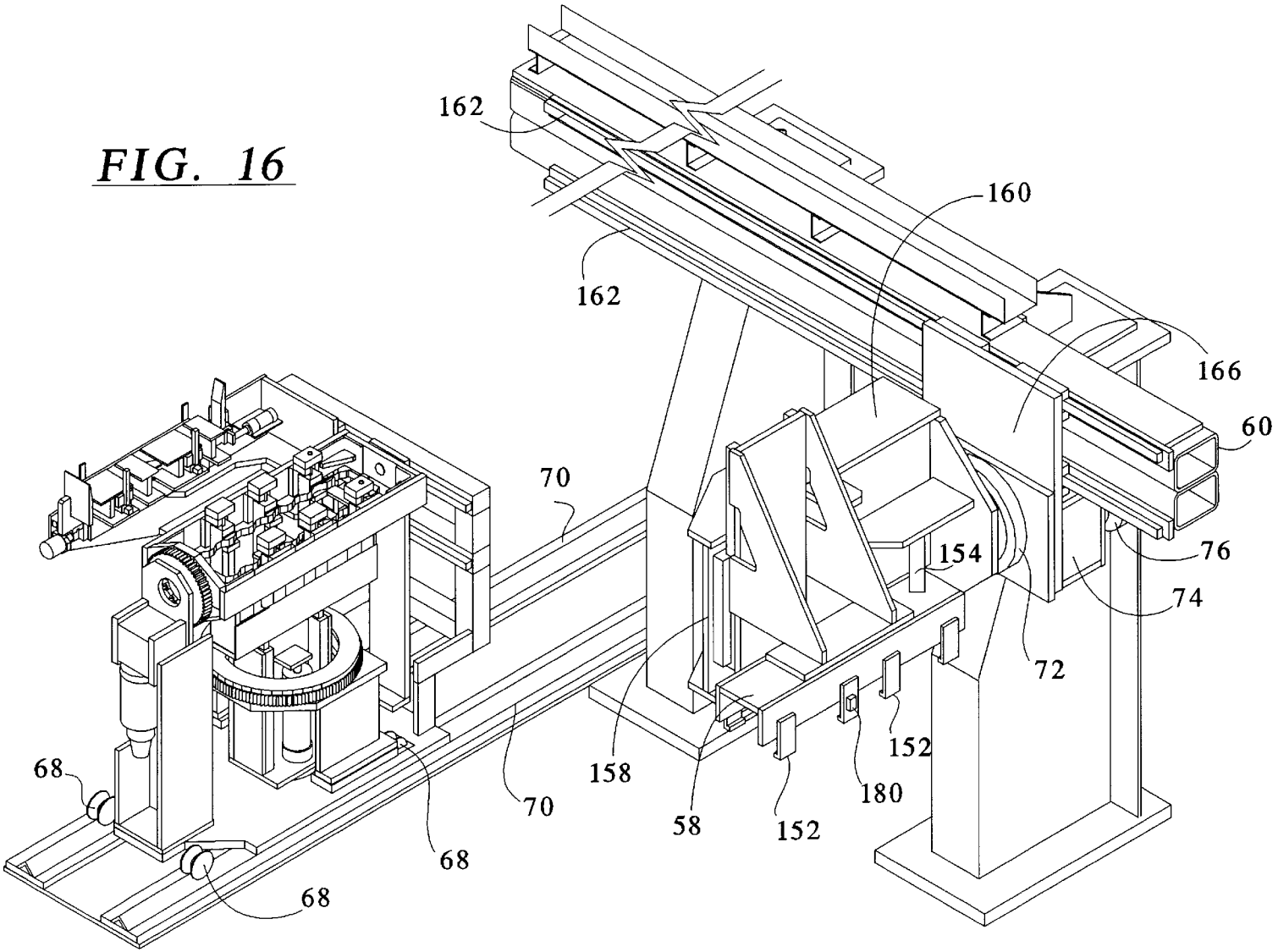
FIG. 16 is a top perspective view of the scroll strip transfer device including the stack accumulating and blocking mechanism, the lift, rotate and turn-over apparatus, and a gripper head on a gantry.
Figure 17:
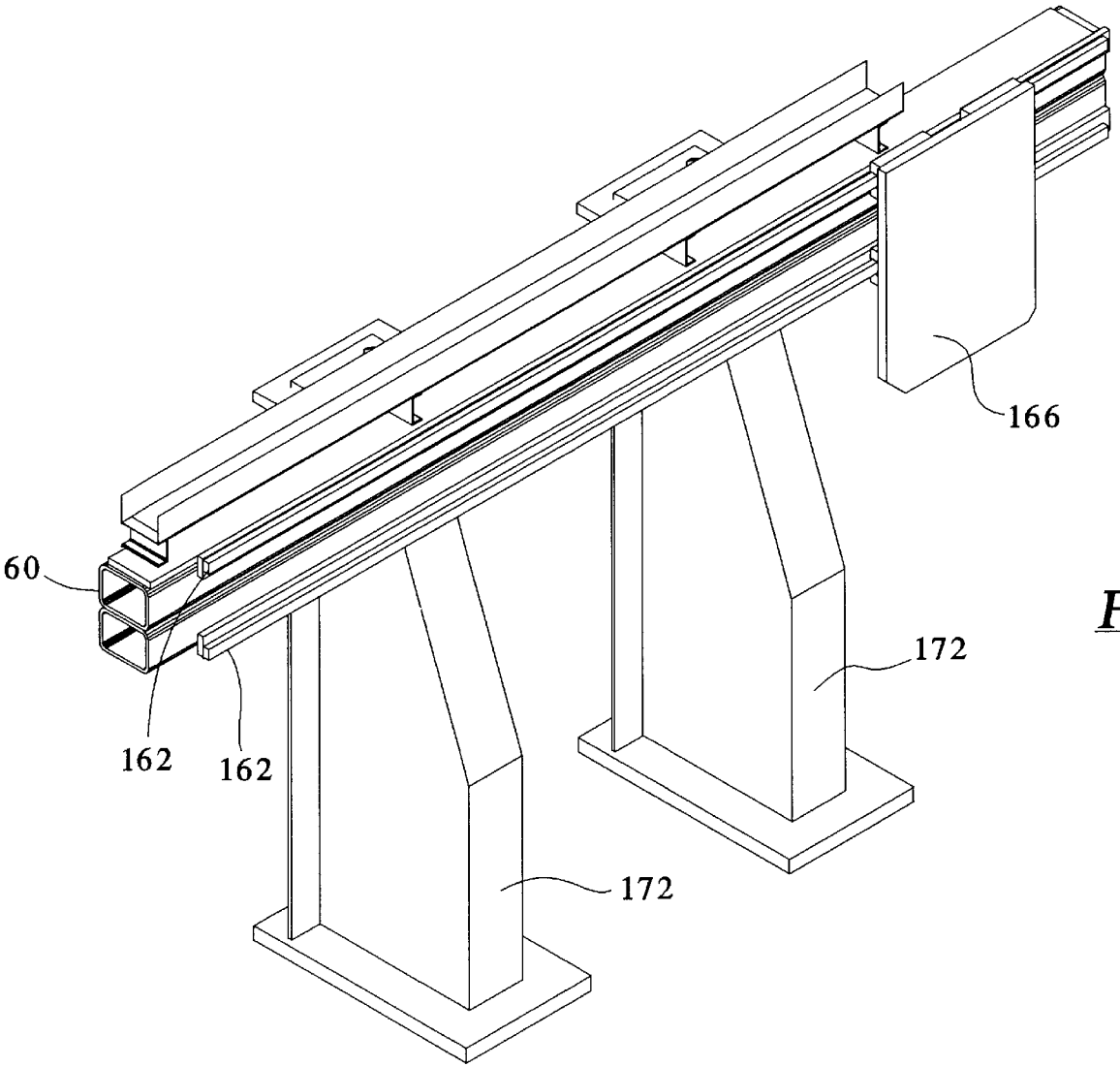
FIG. 17 is a perspective view of the gantry of the present invention.
Figures 18, 19, 20:
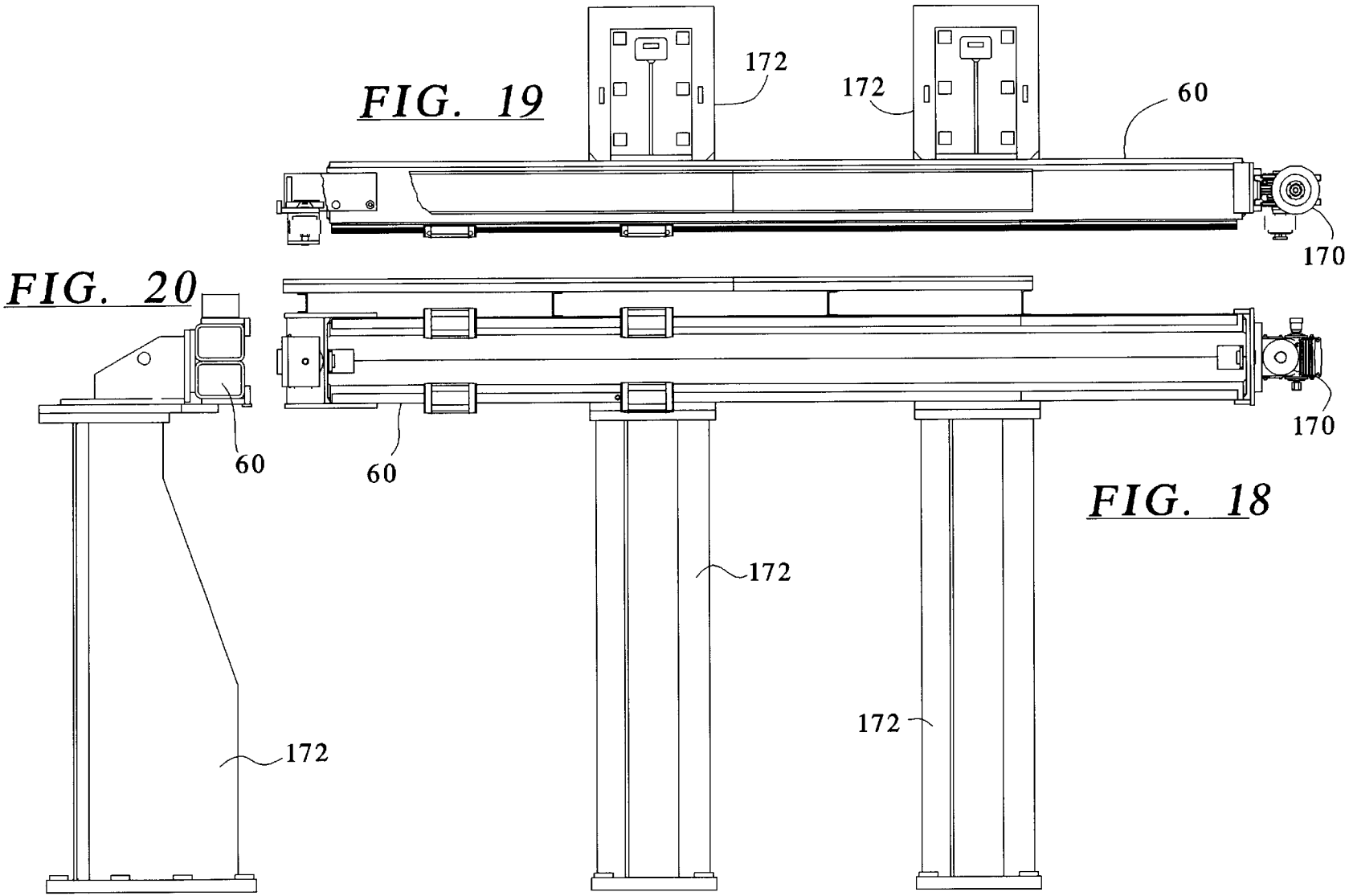
FIG. 18 is a front elevational view of the gantry of FIG. 17.
FIG. 19 is a top plan view of the gantry of FIG. 17.
FIG. 20 is an end elevational view of the gantry of FIG. 17.
Figure 22:
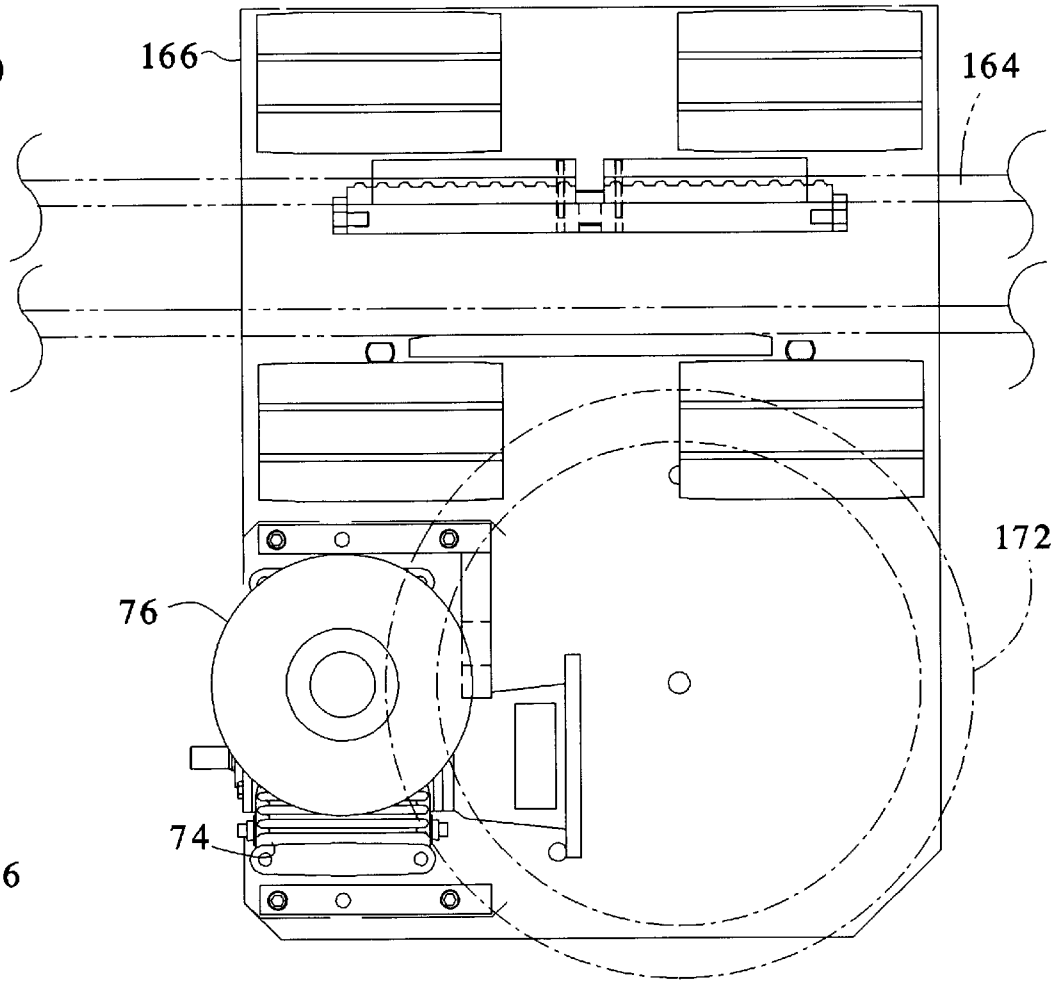
FIG. 22 is a back elevational view of the rotation apparatus of FIG. 21.
Figure 21:
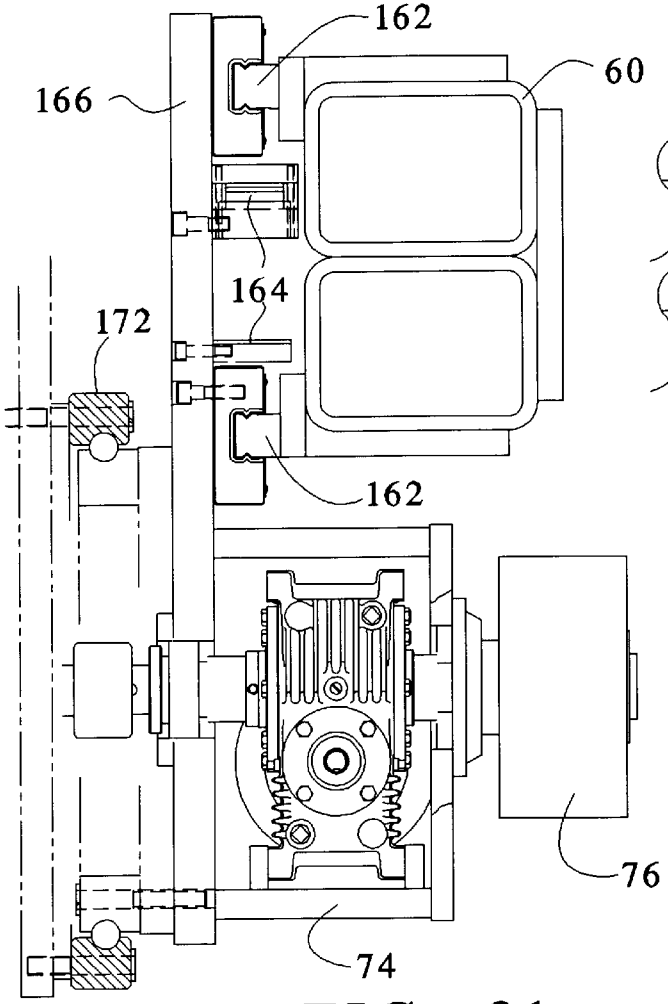
FIG. 21 is a cross section of the rotation apparatus for the gripper head.

After the turn-over frame is rotated, the clamps 140, which are now located on the top of the frame 132 in the orientation shown in FIGS. 13 and 14, are moved to their release position so that they are out of the path of travel of the stack.

Figure 15:
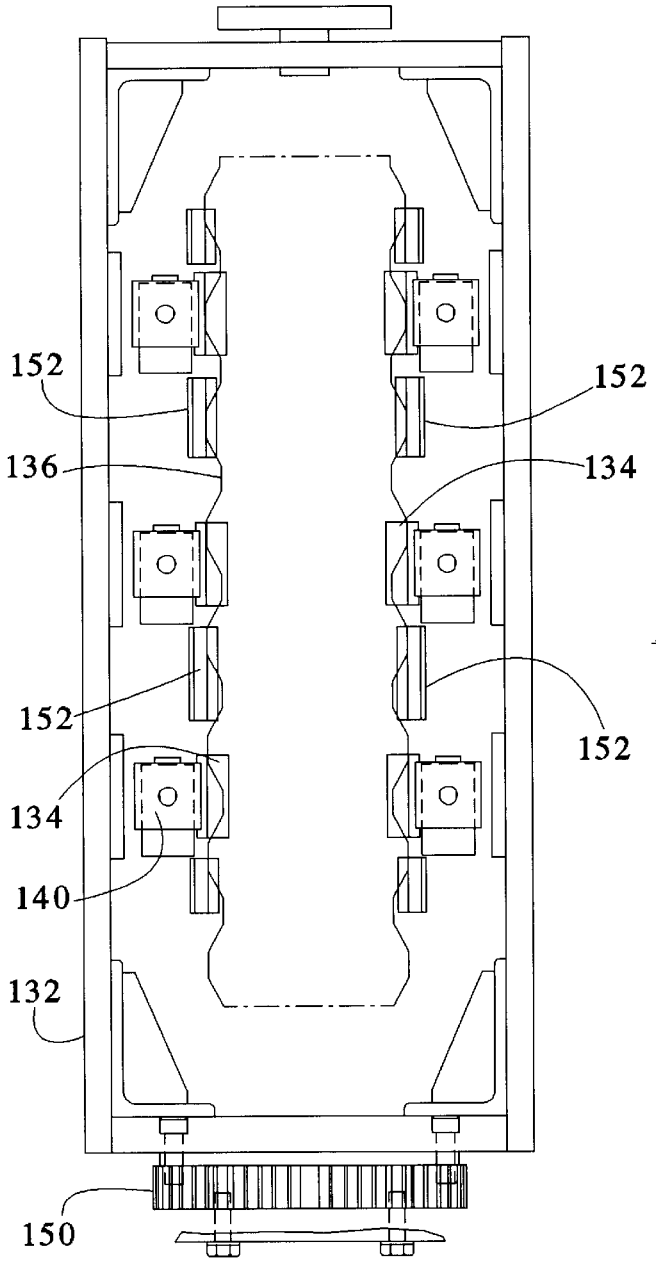
FIG. 15 is a plan view of the turn-over portion showing the relationship between the stop blocks in the turn-over frame and gripper fingers of a gripper head.
Figure 24:
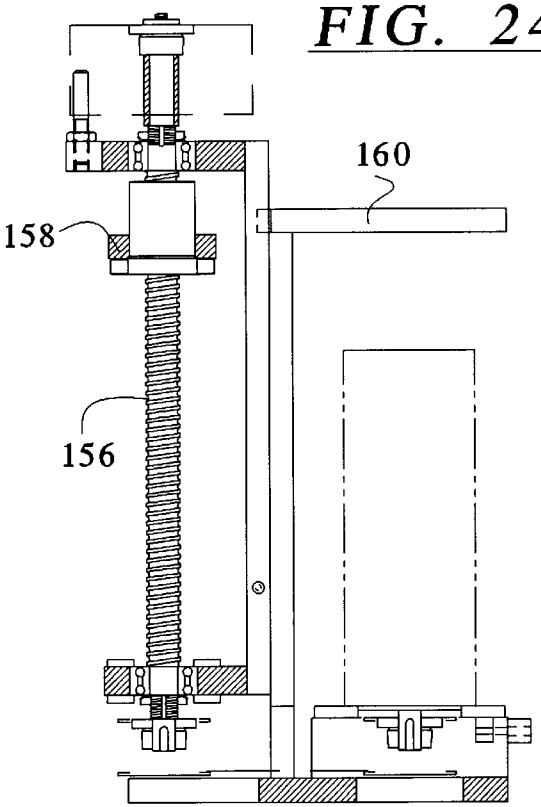
FIG. 24 is a side elevational view of the lowering and raising mechanism of FIG. 23.
Figure 23:
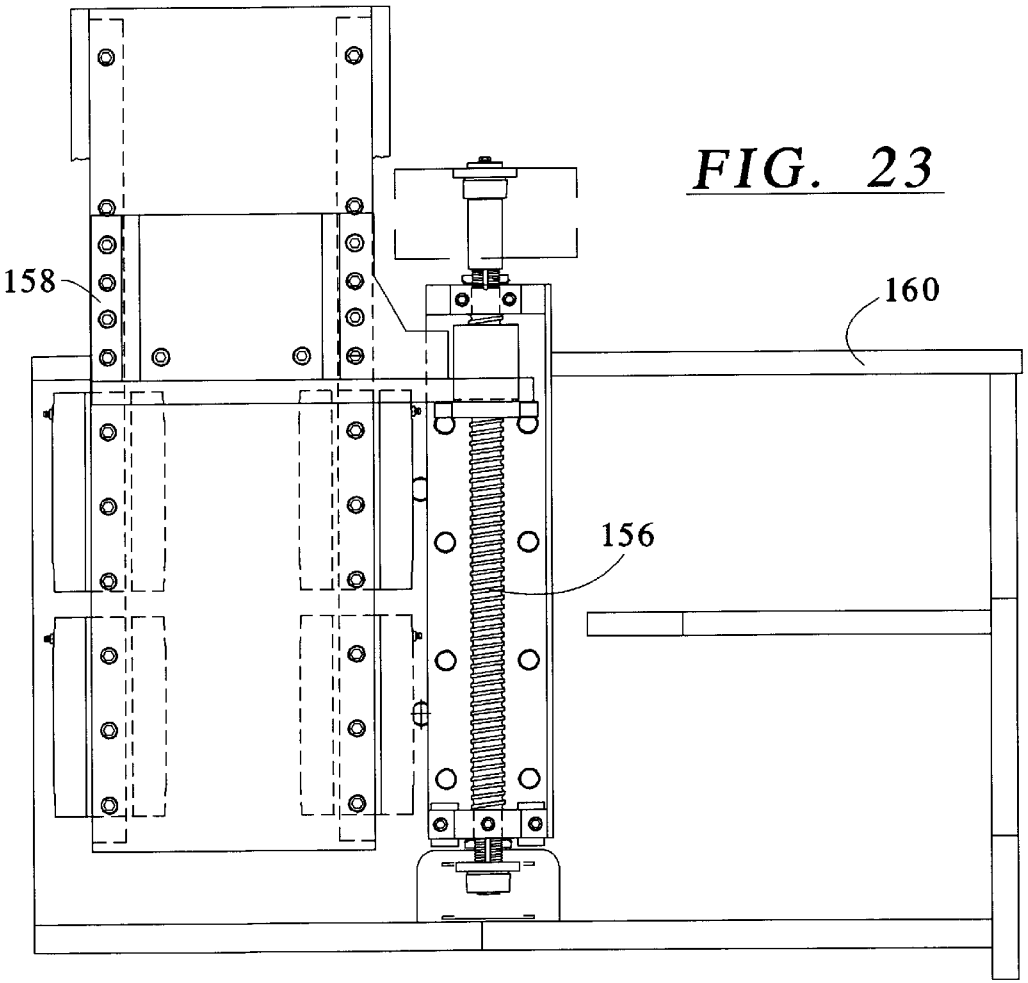
FIG. 23 is a front elevational view of the gripper head lowering and raising mechanism.

A gripper head 58 of the type disclosed in U.S. Pat. No. 5,122,030 and U.S. Pat. No. 5,333,985, which are incorporated herein by reference, is moved into position over the stack of strips in the frame 132. The gripper head 58 is lowered so that fingers 152 on the head 58 are in position on opposite sides of the stack 136. The gripper fingers 152 of the gripper head are positioned relative to the stop blocks 134 so that the gripper fingers 152 extend between the stop blocks 152 as shown in FIG. 15. The pneumatic gripper cylinder 154 on the gripper head 58 is thereafter activated to move the gripper fingers 152 toward one another. Extensions on the gripper fingers 152 extend under the edges of the stack. The gripper head 58 is then moved upward by a vertical lift screw 156 shown in FIGS. 23 and 24. The gripper head is on one end of the vertical lift 158 and the other end of the vertical lift is supported on an arm 160 on the gantry 60.

The gantry 60 is a horizontal beam with rails 162 on which rides the arm 160 that supports the vertical lift 158. A toothed belt 164 extending about pulleys on the horizontal beam 60 is connected to the arm 160 by a plate 166 so that driving of the toothed belt 164 by a gantry motor 170 causes the plate 166 and gripper head 58 to be translated horizontally to a position over the hopper of the scroll press. The gantry 60 is mounted on support legs 172 that high enough that the beam 60 can be located extending over other machinery and can provide a walkway therebeneath. The gantry 60 is set up according to the plant configuration to extend from the scroll cut-off shear 50 to the scroll press 62.

The gripper head 58 of the present invention differs from the known gripper heads in that an angle drive 72 is provided by which the head is positioned at an angle to horizontal. The hopper 62 into which the scroll strips are fed for cutting into individual can ends is at an angle. The present angle drive therefore duplicates the angle of the hopper and provides that once the gripper head is in position over the hopper, the gripper head is swung into the angled position and then lowered along the feed path of the strips in the hopper.

Sensors 180 on the gripper head 58 detect the position of the top strip in the stack of strips already in the hopper 62. The master controller 88 monitors the sensors 180 and causes the downward movement of the gripper head, which is at the feed angle of the hopper, to halt just before the gripper head reaches the to of the hopper stack. The gripper actuating cylinder 154 is then operated to open the gripper fingers 152 and deposit the stack on the top of the strips in the hopper. Since the stack is deposited in the hopper with little vertical drop, the feed mechanism of the scroll press is less likely to misfeed. Uninterrupted operation of the can end manufacturing line is, thus, provided.

Should the hopper 62 of the scroll press be full, as determined by sensor 182 mounted on the hopper which are connected to the master controller 88, the gripper head on the gantry 60 may be moved to a storage position 66 beyond the hopper. Once in the storage position, the gripper head is lowered until a top of a stack is reached. The stack in the gripper head 58 is then released in the same manner as the release of the stack in the hopper. The storage location can include pallets or other support means on which the stack is supported.

Figure 7:
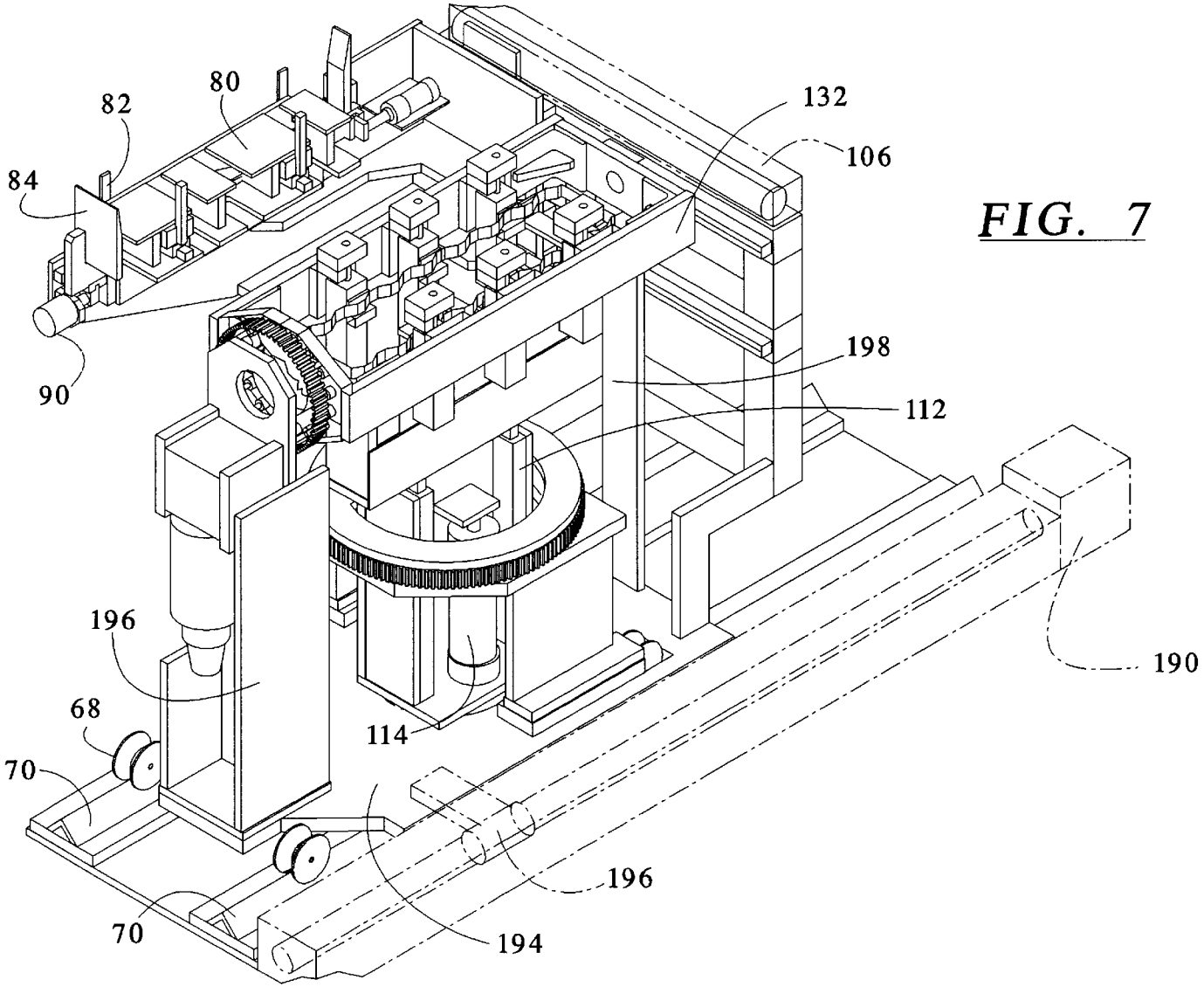
FIG. 7 is a front perspective view of the lift, rotate and turn-over mechanism of FIG. 6.
Figure 8:
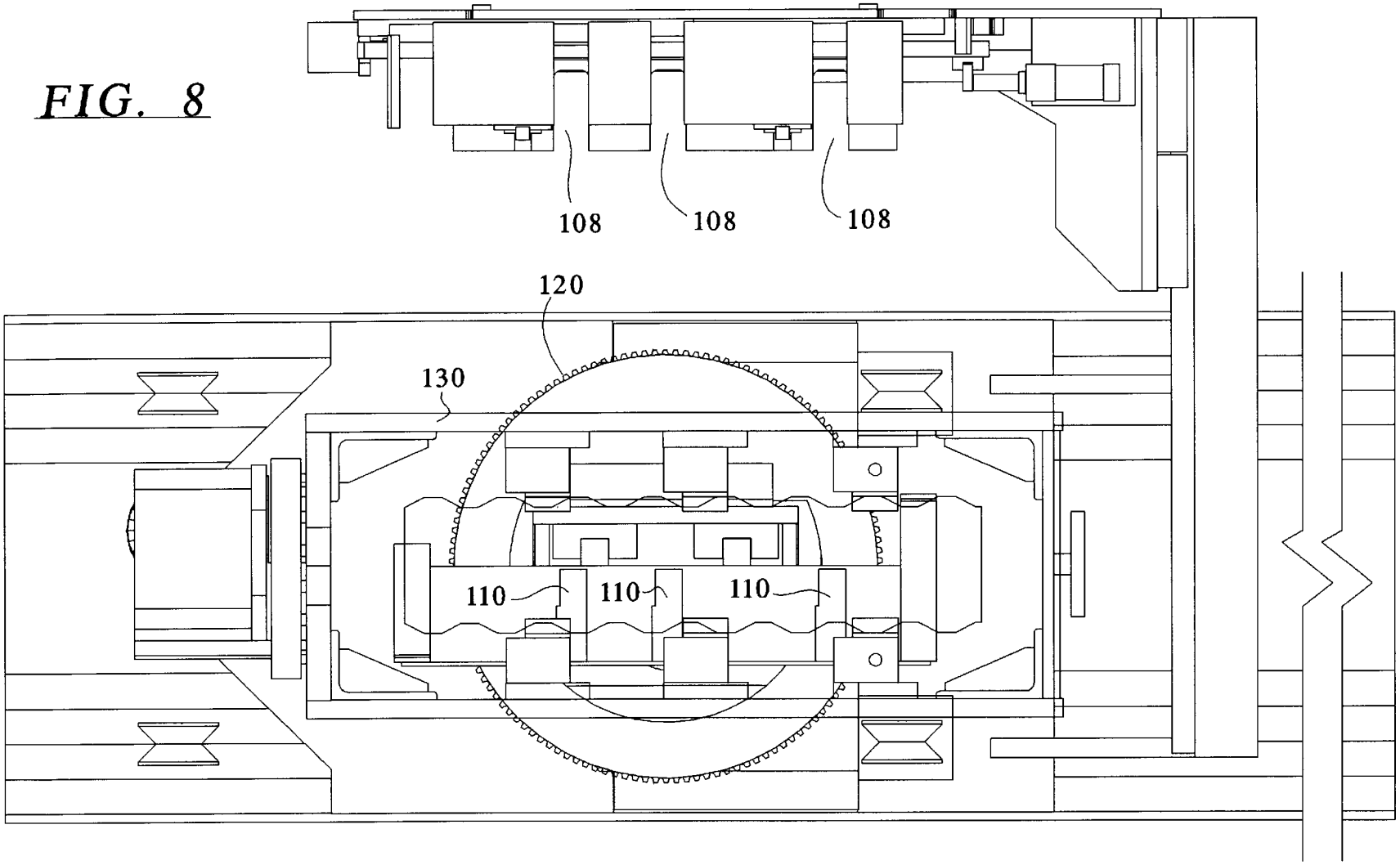
FIG. 8 is a top plan view of the lift, rotate and turn-over mechanism of FIG. 6.

As mentioned above, the lift, rotate and turn-over mechanism is on wheels 68 that ride on rails 70 to move the mechanism from in front of the shear. As shown in FIG. 7, a motor 190 and actuator 192 are provided for moving the mechanism on the rails 70. For the sake of clarity, the box over the wheels 68 is not shown, although the wheels 68 are connected to a base 194 on which the mechanism is supported. Various upright support members 196 and 198 support the turn-over frame 132 over the lift mechanism 112.

Although other modifications and changes may be suggested by those skilled in the art, it is the intention of the inventors to embody within the patent warranted hereon all changes and modifications as reasonably and properly come within the scope of their contribution to the art.

We claim:

1. An apparatus for transporting strips to a hopper, comprising:

an accumulating pocket arranged to catch the strips so that the strips are disposed one on another to form a stack of strips;

laterally movable uprights selectively movable against the sides of the stack for aligning said strips in said stack with one another;

rails on which said accumulating pocket is supported and an actuator for moving said pocket along said rails for transferring said stack to a first position at a rotate station;

a rotatable strip supporting portion for selectively rotating said stack end-for-end at said rotate station;

a lift connected to said rotatable strip supporting portion for selectively lifting said rotatable strip supporting portion to engage and lift said stack from said accumulating pocket when said accumulating pocket is at said rotate station, said lift being operable to lift said stack to a second position at said rotate station above said first position;

a gripper operable for engaging said stack at said second position at said rotate station;

a transfer gantry connected to said gripper for transporting said stack from said second position at said rotate station to the hopper; and an angle drive connected to said gripper for feeding said stack into the hopper at an angle corresponding to a feed angle of the hopper, the feed angle of the hopper being at an angle to vertical.

2. An apparatus for transporting strips to a hopper as claimed in claim 1, wherein said accumulating pocket includes:

a discontinuous lower strip supporting surface and uprights extending perpendicularly from the supporting surface to form a pocket to catch the strips, and wherein said laterally movable uprights includes:

blocking actuators connected to move ones of said laterally movable uprights alternately toward and away from the strips to block the strips in a stack.

3. An apparatus as claimed in claim 2, wherein said discontinuous lower strip supporting surface is movably supported on said rails and said actuator is connected to move said discontinuous lower strip supporting surface.

4. An apparatus as claimed in claim 1, wherein said rails and actuator transfer said stack by lateral linear movement from a position to catch the strips to said rotate station.

5. An apparatus as claimed in claim 1, wherein said transfer gantry is an overhead gantry.

6. An apparatus as claimed in claim 1, wherein said lift includes a lift cylinder connected to lift said rotatable strip supporting portion.

* * * * *